US008192058B2

(12) United States Patent
Chou et al.

(10) Patent No.: US 8,192,058 B2
(45) Date of Patent: Jun. 5, 2012

(54) LED RECESSED LIGHT WITH TRANSPARENT BOARD

(75) Inventors: Meng Hsieh Chou, Sinjhuang (TW); Yen Chi Wu, Sinjhuang (TW)

(73) Assignee: I-Chiun Precision Industry Co., Ltd., Taipei County (TW)

( * ) Notice: Subject to any disclaimer, the term of this patent is extended or adjusted under 35 U.S.C. 154(b) by 236 days.

(21) Appl. No.: 12/703,763

(22) Filed: Feb. 11, 2010

(65) Prior Publication Data

US 2011/0075432 A1 Mar. 31, 2011

(30) Foreign Application Priority Data

Sep. 25, 2009 (TW) ..... 98217690 U

(51) Int. Cl.
*F21V 3/00* (2006.01)

(52) U.S. Cl. ..... 362/311.02; 362/294; 362/311.01; 362/364; 362/373; 362/800

(58) Field of Classification Search ..... 362/294, 362/311.01–311.02, 364, 373, 800
See application file for complete search history.

(56) References Cited

U.S. PATENT DOCUMENTS

2008/0106907 A1* 5/2008 Trott et al. ..... 362/368
2008/0310154 A1* 12/2008 Van de Ven et al. ..... 362/231

* cited by examiner

*Primary Examiner* — Stephen F Husar
*Assistant Examiner* — Meghan Dunwiddie
(74) *Attorney, Agent, or Firm* — Ming Chow; Sinorica, LLC

(57) ABSTRACT

An LED recessed light with transparent board includes a heat sink base, an LED illumination module, a sleeve, a transparent board and a positioning element. The heat sink base has a first surface and a second surface. The LED illumination module is mounted on the first surface of the heat sink base thereof. The sleeve is mounted on the first surface of the heat sink, so as to the LED illumination module is located within the sleeve, and the sleeve is formed with an open end, which has an internal flange. The transparent board is arranged at internal flange of the sleeve for covering the sleeve. And the positioning element is mounted at the sleeve for positioning the transparent board.

5 Claims, 2 Drawing Sheets

LED RECESSED LIGHT WITH TRANSPARENT BOARD

FIELD OF THE INVENTION

The present invention relates to an LED recessed light with transparent board, and in particular to an LED recessed light capable of assembling easily to reduce the cost of manufacturing.

DESCRIPTION OF THE RELATED ART

Since light emitting diodes (LEDs) feature the high brightness, power saving and long life expectancy advantages, they have been used extensively for the illumination of lamps. Several LED lamps are usually connected to form an LED lamp set, and the position of each lamp can be adjusted to achieve an illumination effect to meet the requirements for a large projecting area and a high brightness. These LED lamp sets are used as illuminating devices indoors and outdoors. However, it is necessary to plan the LED lamps and the layout of different projecting areas, so as to differentiate the projecting area for each LED lamp with a different distance from the LED lamp and the projecting area, and prevent an uneven brightness of the light projected from the LED lamps onto the projecting areas. Therefore, it is an important subject for manufacturers in the related field to design an LED lamp with good directionality and even brightness.

As is generally known in the art, use has been made of varying kinds of illumination lamps for lightening or illuminating objects at night or indoors. Such illumination lamps are supplied with electric energy from a power source and convert the electric energy to light energy, thereby producing a beam of light for illumination. Typical examples of the illumination lamps include a glow lamp and a fluorescent lamp.

Widely used in recent years is a Light Emitting Diode (LED) illumination lamp that has a benefit of providing illumination of different colors, although higher in price than the typical lamps referred to above. However, the LED illumination lamp poses a drawback in that it tends to be heated up and shows decreased efficiency when used for more than a predetermined time period. Use of the LED lamp for a prolonged period of time may result in excessive heat generation, thus shortening the life span of the lamp.

SUMMARY OF THE INVENTION

An object of the present invention is to provide an LED recessed light with transparent board capable of assembling easily to reduce the cost of manufacturing.

To achieve the above-mentioned object, the present invention includes a heat sink base having a first surface and a second surface, an LED illumination module is mounted on the first surface of the heat sink base thereof, an sleeve is mounted on the first surface of the heat sink, so as to the LED illumination module is located within the sleeve, the sleeve is formed with an open end, which has an internal flange, a transparent board is arranged at internal flange of the sleeve for covering the sleeve, and a positioning element is mounted at the sleeve for positioning the transparent board.

DETAILED DESCRIPTION OF THE INVENTION

Figure 1:
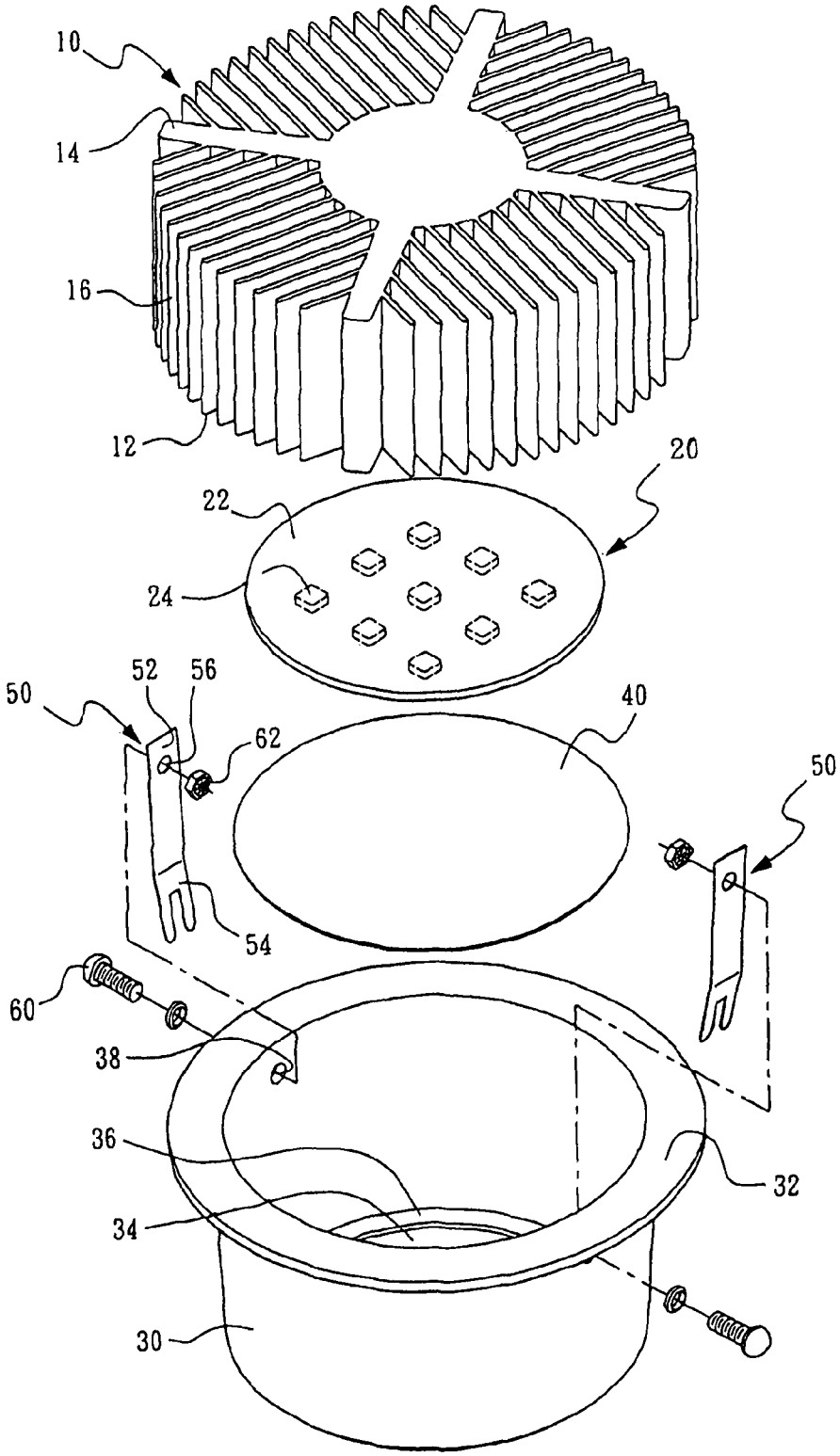
FIG. 1 is an exploded view of an LED recessed light with transparent board of the present invention
Figure 2:
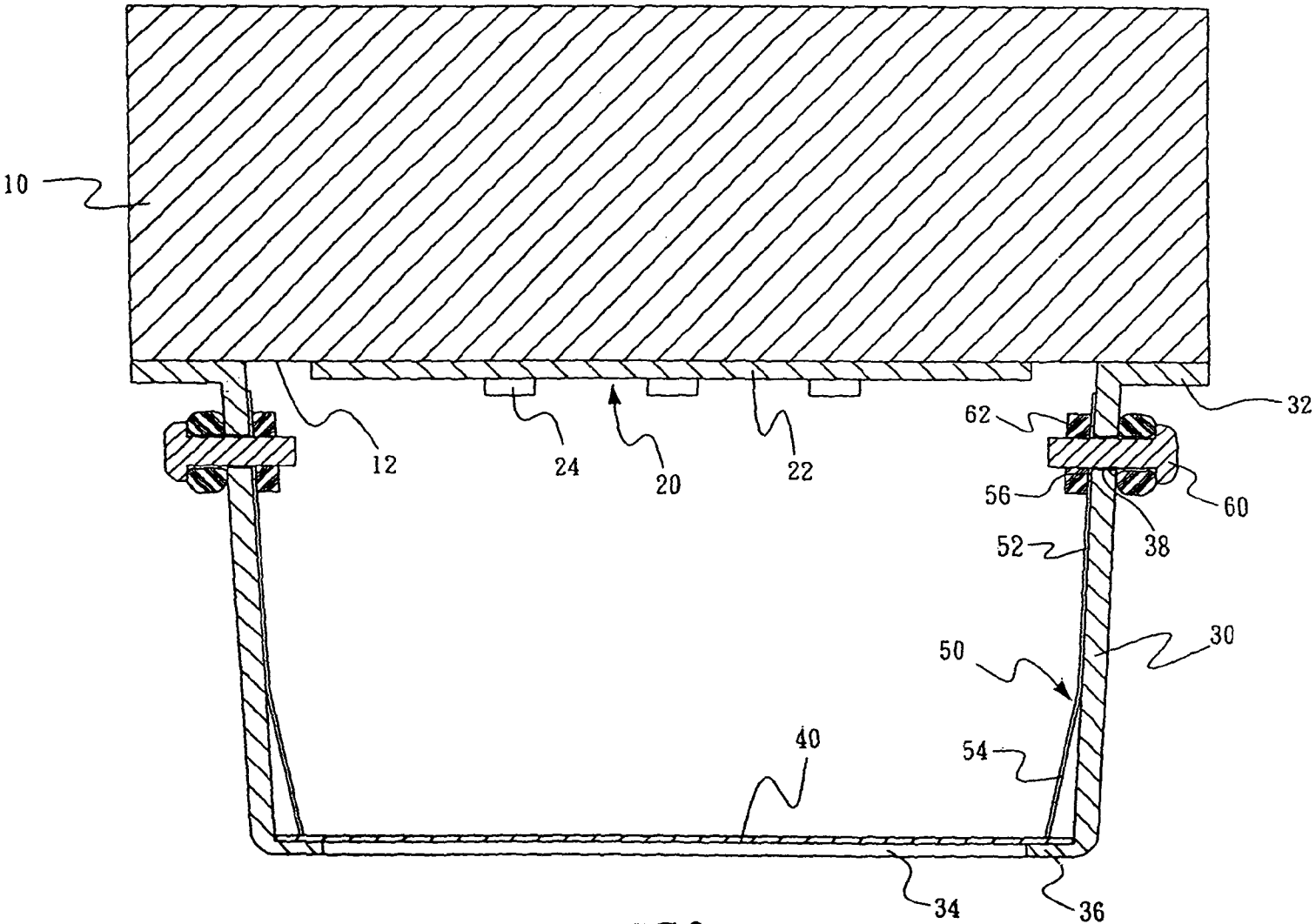
FIG. 2 is a cross-sectional view of assembly drawing of the FIG. 1.

Referring to FIG. 1 and FIG. 2, an LED recessed light with transparent board of the present invention includes a heat sink base 10, an LED illumination module 20, a sleeve 30, a transparent board 40 and a fixed element 50.

The heat sink base 10, which is integrally having a first surface 12, a second surface 14, and a plurality of heat sink sheets 16 are formed at the periphery of the heat sink base 10.

The LED illumination module 20, which includes a print circuit board 22 and a plurality of LED 24 located on the print circuit board 22, wherein the print circuit board 22 is mounted on the first surface 12 of the heat sink base 10.

The sleeve 30, which is a hollow body having an open end 34 and an external flange 32 formed in other end, the external flange 32 of the sleeve 30 is mounted on the first surface 12 of the heat sink 20, so as to the LED illumination module 20 is located within the sleeve 30, the open en 34 is formed with an internal flange 36, further lateral side of the sleeve 30 is formed with a first fixed holes 38.

The transparent board 40 is arranged at internal flange 36 of the sleeve 30 for covering the sleeve 30. And The positioning element 50, which is a sheet body arranged within the sleeve 30, wherein the positioning element 50 has a positioning portion 52 and a pressed portion 54, which is formed an included angle with the positioning portion 52, the positioning portion 52 of the position element 50 has a second fixed holes 56 correspond to the first fixed holes 38 of the sleeve 30, so as to the positioning element 50 may be mounted on the sleeve 30 by a fixed element 60 inserted the first fixed hole and the second fixed hole 56. Thus, the pressed portion 54 of the positioning element 30 may pressed the transparent board 40 to the internal flange 30 of the sleeve 30.

While the present has been described by way of an example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modification.

What is claimed is:

1. An LED recessed light with transparent board comprising:

a heat sink base having a first surface and a second surface;

an LED illumination module being mounted on the first surface of the heat sink base;

a sleeve being mounted on the first surface of the heat sink, so as to the LED illumination module is located within the sleeve, and the sleeve being formed with an open end, which has an internal flange;

a transparent board being arranged at internal flange of the sleeve for covering the sleeve;

a positioning element being mounted at the sleeve for fixing the transparent board;

the positioning element comprising a positioning portion and a pressed portion;

the positioning portion being fixed at the sleeve; and the pressed portion pressing the transparent board to the internal flange of the sleeve.

2. The LED recessed light with transparent board according to claim 1, wherein the heat sink base having a plurality of heat sink sheets.

3. The LED recessed light with transparent board according to claim 1, wherein the LED illumination module including a print circuit board, which being mounted at the first surface of the heat sink base, and a plurality of LED being formed on the print circuit board.

4. The LED recessed light with transparent board according to claim 1, wherein the sleeve further comprising an external flange, which being mounted on the first surface of the heat sink base.

5. The LED recessed light with transparent board according to claim 1, wherein the positioning portion and the pressed portion of the positioning element being formed with an included angle.

* * * * *